US006031517A

United States Patent [19]

Van Nes

[11] Patent Number: 6,031,517

[45] Date of Patent: Feb. 29, 2000

[54] MULTI-COLOR DISPLAY UNIT, COMPRISING A CONTROL ARRANGEMENT FOR COLOR SELECTION

[75] Inventor: Floris L. Van Nes, Eindhoven, Netherlands

[73] Assignee: U.S. Philips Corporation, New York, N.Y.

[21] Appl. No.: 07/928,883

[22] Filed: Aug. 11, 1992

Related U.S. Application Data

[63] Continuation of application No. 07/608,594, Oct. 29, 1990, abandoned, which is a continuation of application No. 07/312,319, Feb. 16, 1989, abandoned, which is a continuation of application No. 07/043,520, Apr. 28, 1987, abandoned.

[30] Foreign Application Priority Data

Dec. 15, 1986 [NL] Netherlands ..... 8603180

[51] Int. Cl.[7] ..... G09G 5/02

[52] U.S. Cl. ..... 345/150; 345/141; 345/199; 345/22; 345/26; 345/114

[58] Field of Search ..... 340/701, 703, 340/702, 723, 730, 747, 731, 744, 737, 738, 748, 750, 711; 358/763, 81, 260; 345/22, 25, 26, 114, 141, 150, 199

[56] References Cited

U.S. PATENT DOCUMENTS

| | | | |
|---|---|---|---|
| 3,685,038 | 8/1972 | Flanagan | 340/703 |
| 3,911,418 | 10/1975 | Takeda | 340/703 |
| 4,016,365 | 4/1977 | Staar | 340/711 |
| 4,217,577 | 8/1980 | Roe et al. | 340/703 |
| 4,232,311 | 11/1980 | Agneta | 340/703 |
| 4,408,200 | 10/1983 | Bradley | 340/703 |
| 4,467,322 | 8/1984 | Bell et al. | 340/703 |
| 4,654,720 | 3/1987 | Tozawa | 340/703 |
| 4,710,806 | 12/1987 | Iwai et al. | 358/81 |
| 4,727,414 | 2/1988 | Ranf et al. | 358/166 |
| 4,727,425 | 2/1988 | Mayne et al. | 340/703 |
| 4,734,619 | 3/1988 | Havel | 340/703 |
| 4,837,710 | 6/1989 | Zelinsky et al. | 340/703 |

FOREIGN PATENT DOCUMENTS

| | | | |
|---|---|---|---|
| 1200631 | 2/1986 | Canada | 375/22 |
| 2032740A | 5/1980 | United Kingdom | G06F 3/153 |

OTHER PUBLICATIONS

Foley et al, "Fundamentals of Interactive Computer Graphics", Addison–Wesley Publishing Company; Jul., 1984, pp. 602–606, and 621.

"The Business of Words" PC Magazine, Jan. 28, 1986, pp. 159–161 and 173–174.

*Primary Examiner*—Steven J. Saras

*Attorney, Agent, or Firm*—Brian J. Wieghaus

[57] ABSTRACT

A multi-coloured display unit is described for characters having colour indicator signals. The characters can be displayed in a plurality of colours. Without information of the identify of the characters getting lost, the legibility structure is influenced by the spreading of the colours over the various parts of the text. Initially, such colours are preselected when compiling the text. However, for various implementations this spreading is sub-optimal. Consequently, a transforming device is comprised for realizing and implementing a different colour structure and hence improving the legibility structure depending on the application and the original structure of the colour.

1 Claim, 1 Drawing Sheet

MULTI-COLOR DISPLAY UNIT, COMPRISING A CONTROL ARRANGEMENT FOR COLOR SELECTION

This is a continuation of application Ser. No. 07/608,594, filed Oct. 29, 1990, now abandoned, which is a continuation of Ser. No. 07/312,319 filed Feb. 16, 1989, now abandoned which is a continuation of Ser. No. 07/043,520 filed Apr. 28, 1987, now abandoned.

BACKGROUND OF THE INVENTION AND EXEMPLARY STATE OF THE ART

The invention relates to a multi-colour display unit for characters provided with colour indicator signals, comprising a picture memory for storing all characters to be displayed together, a colour transforming arrangement for modifying at least one predetermined colour indicator, and a picture field arrangement connected to the picture memory and the transforming arrangement, respectively. Such a multi-colour display unit is known from the German Offenlegungsschrift 3112249. In the latter patent the picture field arrangement is a cathode ray tube having three guns which can form red, blue and green picture elements, (pixels). In addition, when combining two guns the colours yellow (red and green), cyan (blue and green) and magenta (blue and red) can be formed. Finally the colours "white" (three guns) and "black" (no gun) can be formed. According to the above Offenlegungsschrift one or a plurality of these eight colours is/are modified by blending with a primary colour (for example red) a small amount of a different colour (for example green). This modification is achieved for characters, but not achieved for graphical patterns and television pictures. For television pictures the change of brightness to be achieved is hardly ever advantageous. Usually, no advantage can be gained for graphical patterns, although there are exceptions to the rule. The known measure affects the relative brightness of the characters to be displayed. However, the colour shade is affected only slightly and it is also intended to be. Moreover, the number of colours and their assignment remain unchanged.

PHILOSOPHY OF THE INVENTION

At a higher organisation level specific parts of the text (character elements i.e. specific characters, words, lines of text) and sometimes also supporting elements of the text (such as underlinings, vertical dividing lines, space lines or bars, background of a character field) are displayed in different colours when displaying text on a picture field. When making such a text design (organized page-by-page or otherwise) a designer selects a plurality of colours. For example text white, headings red and green, certain essential words in the text yellow, space bars cyan. Basically, any other combination of the abovedescribed eight colours is possible. The aforenoted combination of colours is used as the designers wish colourfulness and have a vague to sharply defined wish for structuring the displayed information so as to improve legibility. The information per se is available in the characters, irrespective of the picture's colour; the colour merely serves as a support to attract the viewer's attention. Thus the use of colour affects the legibility structure; that is to say the relative and spatially structured conspicuousness of the text picture and the capacity of being distinguished. The overall view and legibility are affected thereby.

SUMMARY OF THE INVENTION

In the above the designer of the text picture generally strives to use the technical possibilities relatively often and to a large extent. It has appeared to the inventor that the result of this way of thinking and course of action results in insufficient legibility as the laws of the use of colours are insufficiently known to the designer. A designed page is stored, for example, in a medium to be selected for re-display by a user such as a teletext or a viditel page or otherwise. The above also applies to a page which is used to produce a hard copy. The invention is not restricted to the use in cathode ray tubes, for other multi-colour display systems can cause similar problems.

The invention has for its object to provide means which are capable of modifying selectively and automatically or not automatically the use of colours to improve the legibility structure. The legibility structure need not be optimal to all users at the same colour setting. This can depend on the user's visual sense (for example on the user's being colour blind to a certain extent, on the extent and form of the user's reading field). The desired, or optimal legibility structure can also depend on a user's intention such as:

creating a text picture;

checking the subdivision of a text picture in paragraphs, etc.;

checking the use of colours and optimizing them;

correcting, for example, spelling mistakes.

In the latter case specific critical elements of a text will have to be coloured rather conspicuously.

ADDITIONAL ASPECTS

The invention can be used in practice for designing a text picture. The invention can also be used for displaying a text picture, which information is received from the store or transmission medium, modifying the colours used to influence the legibility structure. Subsequently, the colour range can still be influenced. With the above the invention does not relate to displaying a colour picture as a monochrome picture, but to changing a colour into a different colour whilst maintaining the multi-coloured picture. When doing so the substitute colour as such can be white, but then another colour is additionally displayed as "non-white" and also "non-black". Various possibilities for such a colour transposition can be attractive. In many cases the number of colours will be reduced. By suppressing undesired, bright colours, the colour range can be reduced as it were. Alternatively, the colour range can also be expanded to make certain parts of the picture more prominent. Therefore, the invention does not relate to displaying specific words in a striking colour on the basis of the contents of that word as verified via an associative search mechanism. The invention disregards the meaning of the text but only considers the presentation of the components of the text, for example, colour information already available, capitals, first word of a paragraph, underlined words, numbers. The latter use is attractive for making certain kinds of words (numbers, names) more prominent, so that they are readily visible as candidates for optional corrections. The fact that other words starting with a capital or numbers which are not crucial (for example page number as against giro numbers or money amounts) are made brighter too, will generally be no objection.

The colour range can also be changed to make the text more legible for certain reader categories; for example, for sufferers of certain forms of colour blindness the current colour range can automatically be transformed into another colour range. This can be achieved without intervention, for example, for each successively received text page. The invention thereto does not relate to transforming the pictures, for example those made in false colours, where in a multi-coloured picture certain zones are accentuated at the cost of others. Such false colours are used to refrain as it were from the irrelevant parts of the picture, and not to produce a certain legibility structure of a text picture. The invention relates to changing the colours used in a text picture, operating on perceptive grounds and the information in the picture being available on two levels, first on the level of the colour and secondly on the level of the form within the field of the text picture accentuated by a colour. On the same grounds the invention does neither relate to the use of such multi-coloured pictures that are used in computer-aided design of (CAD) integrated circuits and other technical products. There are no characters involved there either, assuming various different colours so as to be distinguished from each other and no influencing of the legibility structure by a colour transposition. In addition to characters (letters, figures, punctuation marks, diacritics, symbols), the text can also comprise supporting elements (underlinings, colour dividers, space bars, etc.).

Further attractive aspects of the invention are stated in dependent Claims.

SHORT DESCRIPTION OF THE FIGURES

The invention will further be explained with reference to several Figures, first discussing the features of the colours usage and then appropriate realizations of the arrangements wherein.

FEATURES OF THE COLOUR USAGE

Figure 1:
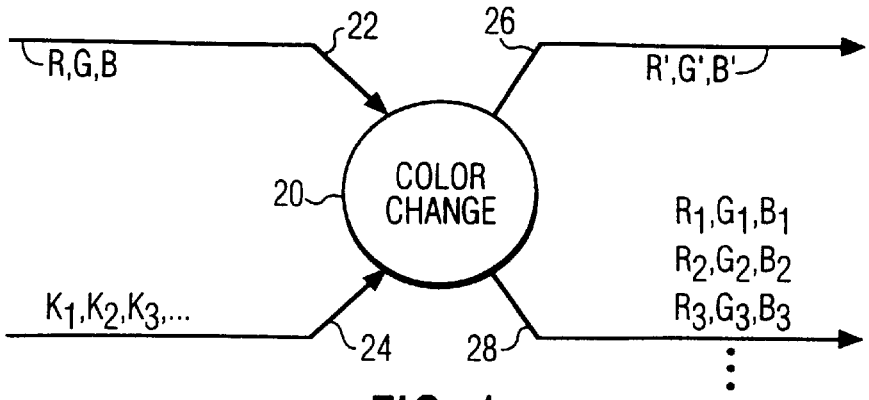
FIG. 1 shows the possibilities of colouring in accordance with the invention.

FIG. 1 shows the options for colour treatment in accordance with the invention. Circle 20 symbolically shows the mechanism of the colour change. On the left two options are shown for supplying the colour indicator signals of the characters and the supporting elements to the system. Arrow 22 shows that for each one of the elements supplied the associated colour indicator indicates a predetermined colour; this is shown as the relative intensity of the primary colours red (R), green (G) and blue (B). Their relative intensities can each be given by one or more bits. If the relative intensity is defined as r, g, b bits, respectively, a total number of $2^{r+g+b}$ different colours are possible. In accordance with the abovementioned state-of the art r=g=b=1, and eight colours will thus be possible. Arrow 24 shows that the characters/supporting elements are subdivided into groups and that there is a colour indicator for each individual group. These colour indicators (K1, K2, . . . ) are not assigned to a specific colour. So, it is possible that after the process two or more different colour indicators will start indicating the same colour, for example K1→K2→white, with at least one other colour indicator indicating non-white.

On the right in the Figure the two options are represented to finally show in the picture field the characters and the supporting elements. Arrow 26 denotes that there is a single output colour indicator for each input colour indicator. The output colour indicator is shown as the relative intensity of the primary colours red (R'), green (G') and blue (B'). These relative intensities will stand for a number of different colours. One (possibly more) of the originally supplied colours is shown on the display as a different colour. This different colour can already be available in the colour range on arrow 22, but not necessarily so. The conversion pattern to be formed according to arrow 26 is a fixed one. A specific received colour is converted into a fixed different colour. A specific colour indicator Kj may be displayed having a fixed colour.

Arrow 28 shows that there are more options for conversion. These options can be selected either subjectively by the user or automatically. The colour indicator Kj, for example, referring to the greater part of the text/supporting elements, will usually be shown as white or yellow.

Table 1 shows four columns, each comprising the eight colours (including the colours black and white of the above mentioned state of the art). The first column shows from top to bottom the order of ever decreasing distinguishability with respect to a black background. Especially blue has a poor distinguishability. In a text picture the colour white will be selected to be the colour for the largest part of the text, so the part containing the most characters, the colour yellow for the second largest text part of a different colour, the colour cyan for the third largest and the colour green for the fourth largest part of the text having a colour different from the other text parts. In many cases the colours magenta, red and blue are not used. Besides, for a text picture a number of four colours will usually suffice. The display system of column A is to be characterized as "neutral".

TABLE 1

| | A | B | C | D |
|---|---|---|---|---|
| 1. | white | yellow | cyan | green |
| 2. | yellow | cyan | green | white |
| 3. | cyan | green | white | yellow |
| 4. | green | white | yellow | cyan |
| 5. | magenta | magenta | magenta | magenta |
| 6. | red | red | red | red |
| 7. | blue | blue | blue | blue |
| 8. | black | black | black | black |

In addition to the above, column B provides a second option for assigning the respective colours: the first four are rotated cyclically, the last four are either not used as in column A, or only used exceptionally. The legibility when using this display range is substantially identical to that of column A. When equally spreading the characters/supporting elements over the four colours, the legibility structure will substantially correspond to that of column A. The display system can be defined as "warm".

Accordingly, the display system of column C is rotated one position for the first four colours and can be defined as "cool, business-like". The display system of column D is rotated one time accordingly for the first four colours and can be defined as "eye-catching". The legibility structure of the last two columns substantially corresponds to that of columns A and B. Needless to observe that table 1 does not show all options. In column D, for example, the colours yellow and cyan can be exchanged. It is likewise possible to apply the measure of the aforenoted state of the art in such a way that the colour blue also gets sufficient brightness to have it rotate with the colours. When depicting a concept of a text, for example, the four columns of table 1 can be selected successively by the apparatus under control of a continuation signal to achieve an optimal legibility structure. Other options can be acceptable too. When starting to make a choice an automatic or non-automatic reset mechanism will see to it that the right column is selected.

Table 2 accordingly shows the sixteen standard colours (including black) of an IBM PC computer. From 1 to 16 there is a continual reduction of visual distinguishability of the colour involved with respect to black. In this case there are a great many options or colours, respectively, to be assigned to the individual sections of the text. Among them there are also colours showing only slight mutual differences such as grey and light grey. If so, the invention can be used for assigning the grey and light grey parts of the text to one and the same final colour and to lay this down for later display, provided the parts do not occur in the same text-picture (page).

TABLE 2

| |
|---|
| 1. white |
| 2. light-cyan |
| 3. cyan |
| 4. light-grey |
| 5. grey |
| 6. light-blue |
| 7. yellow |
| 8. light-green |
| 9. light-red |
| 10. light-magenta |
| 11. green |
| 12. magenta |
| 13. red |
| 14. brown |
| 15. blue |
| 16. black |

The colour range, for example, can be reduced as follows, exclusively showing the picture in colour numbers:

1→1;

2,3→2;

4,5,6,7→4;

8,9,10,11→6;

12,13,14,15→7;

16→16.

In the eight-colour system of table 1 colour blindness or colour weakness can be compensated for to a certain extent in the following manner:

With protanopia and protanomaly (two forms of defective red vision) red and magenta are not observed: green, cyan and blue are then seen as shades of blue. Magenta is now replaced by green and red is replaced by cyan. So this relates to a text for which in FIG. 1 the arrow 22 is used. If magenta and/or red occur, the legibility structure will be changed. This may affect the optimal colours to be selected for the other parts of the text. When compiling the text this can be allowed for by resetting to the position of "defective red vision compensated for" after the normal picture has been produced, whereupon the aforesaid transposition is effected automatically. If the result is unsatisfactory, the designer goes back to the normal picture and autonomously effects therein a colour transposition, for example, by exchanging of two colours. Subsequently, a check may be made at the position "defective red vision compensated for", and further attempts may be made. In the display system according to table 2 either the same options can be maintained or different transpositions can be effected according to one's needs and at one's own discretion. If the right option is found, it will be stored.

With deuteranopia and deuteranomaly (two forms of defective red-green vision) red and magenta are observed more or less as shades of brown; green, cyan and blue as shades of blue. In that case at most only one of the colours red or magenta may be used. They may not be converted into green as this resembles grey too much. Here too a strategy as described before can be pursued when compiling a page of text. In the positions "defective red vision compensated for" and "defective red-green vision compensated for" the colour range is expanded with respect to the normal situation for people having this characterization of vision.

The colour range can also be modified to effect corrections. In the system according to table 2 the digits in a typescript can be corrected by depicting them as light-green (8) and all originally green/light green elements as grey. All other elements can either retain their original colour or be depicted in one fixed colour so that the final picture will only be bi-coloured. Corrections of geographical names, proper names etc. are effected by treating all words starting with a capital/containing at least one capital in the same way as described hereinbefore with respect to the digits. The digits are detected on account of the content of the associated character code. Capitals are detected by the apparatus either on account of the associated character code (it will comprise a "capital" bit), or on account of a "shift code" indicating that the next character is a capital, or that all following characters are capitals, respectively, until a shift-back code is detected.

The correction of titles, headlines etc. is started by having the apparatus first finding the normal margin (when displaying from left to right in a Latin, Greek or Cyrillic alphabet), whilst immediately after that at least one more space character is found. Another criterion is that a preceding line of text completely consists of spaces. It is then assumed that the title fills the entire line. So this method often works on the first line of a paragraph too. For Arabic and Hebrew script, as is well-known, the left hand and right hand side are exchanged. In certain cases the algorithm can also respond to the extended last letter of a word completing a line (as sometimes in Hebrew). For other scripts similar measures are to be implemented to have the apparatus detect significant parts of the text so as to give them more prominance by a specific colour. Tabulations occur in all kinds of scripts. Japanese has various types of characters, for example, kana and kanji. Punctuation marks can be recognized from their own codes. Quotations can be recognized as they are accompanied by quotation marks. Underlined words can be recognized from the "underlining" code. Tables and formulae can be made more prominent in a similar way. A part of the text can be detected, for example, by a space line found over and under the text, whilst the table area misses the front margin at least on the following two lines. Actually, the table seems to consist of a number of consecutive initial lines of a paragraph. Many other methods are conceivable.

DESCRIPTION OF TWO EMBODIMENTS

Figure 2:
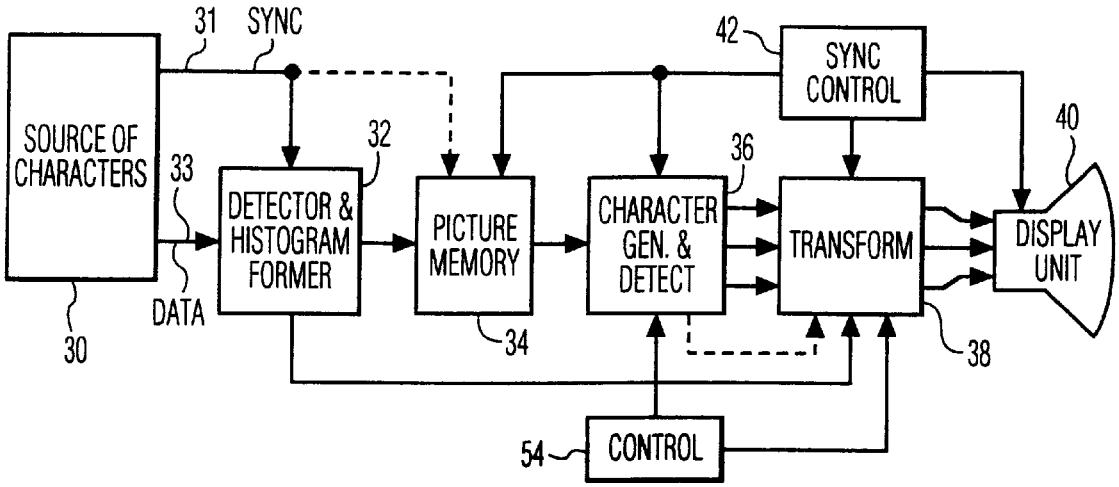
FIG. 2 shows a first embodiment of a multi-coloured display unit in accordance with the invention.

FIG. 2 shows a first embodiment of a multi-colour display unit in accordance with the invention. Block 30 supplies the characters and supporting elements, if any. This can be a keyboard with which a page of text is compiled. It can be a background memory or, for example, a radio connection. This block supplies synchronizing signals on line 31 and information signals on line 33. Block 32 is a detector with attached to it a histogram-former for colour indicator signals. For the time being forming a histogram is not considered. Block 34 is a picture memory. It can store one or more pages of information. A page can be completely displayed on display unit 40. The information can also be arranged as a series of lines of text not belonging to a specific page, so for example by way of a scroll stretching out vertically. The size of a page of text (text picture) can be changed, if required, by tabs, margins etc. The colour conversion to be discussed hereinafter can take place on the basis of one single page. It can also be effected on the basis of the total contents of memory 34. Unit 36 is a character generator. It receives the information of the characters, for example as a six, seven or eight-bit character code, having a three-bit colour code in the organization according to the prior art. On the other hand, memory 34 can also be bit-mapped. In that case a character generator is inserted prior to this memory. The colour code can then be stored per bit. It is possible that when storing characters the colour code comprises a plurality of bits, for example four bits of character-colour and four bits of background-colour. In the latter case the background-colour can be automatically modified if the character-colour is modified. Generally, such a measure can prescribe that a dark background-colour be used with a bright character-colour. The brightness is a consequence of the order shown in the above two tables. Needless to observe that character and background must never have the same colour. memory 34, character generator 36 and the blocks 38, 40 receive synchronizing signals from the control arrangement 42. Hence, in the known way, the character codes are consecutively read and converted into pixels, each pixel in this case having a three-bit colour indication. This enables the formation of the previously-mentioned eight colours. If abstracting from block 38, display un 40 will receive a three-bit signal for each pixel so that there will be eight display options per pixel. Block 38 is the transforming device. It is capable of transforming into a different colour characters supplied in anyone of the eight colours. With this operation the number of primary colours of the transforming device can again be eight, but also less. The strategy to be followed is discussed hereinbefore and can likewise be determined by the output signal of units 32 and 36. The output signal of character generator 36 can detect specific character categories and/or specific text configurations by means of a detector comprised therein, detector comprises storage means, if necessary, for memorizing a specific attribute previously detected on the line (such as "figure detected", "passed margin", "underlining", "no further character than a space on this line", etc.). This detector is set by a control unit 54, for example, comprised in the keyboard. For the relevant control signal, block 36 comprises a decoder activating the selection. Control unit 54 accordingly forms setting signals for the transforming device 38. These signals indicate the respective modes, for example "unchanged", "display according to column A of table 1", "display characters in a specific manner according to detection by the detector of character generator 36". Actually, the logic circuits for the abovementioned detection and control are elementary and are not further discussed for the sake of shortness. Thus a picture in two or more colours can appear at the output of transforming device 38. A uni-coloured picture (plus a different background colour) can also appear, but this is already known.

In FIG. 2 the picture memory 34 can likewise be a memory of pixels: in that case the character generator 36 can be omitted, but will then be comprised in block 30. The colour indication can be added for each character. It is likewise possible to indicate only the colour changes, for example along a line of characters. In that case the character generator comprises a hold circuit for producing the same colour indicator signal during a number of consecutive characters until a colour-change indicator is received. The latter mechanism is known per se and is therefore not further discussed for the sake of brevity.

Unit 32 is a histogram-former. It detects for a page of text the number of characters per colour indicator. If a complete page is received, this histogram-former excites the transforming device 38 such that if a relevant permission signal is received from the control unit 54 (disregarding the "colour" black) the colour found most in the picture is shown as "white", the next colour as "yellow", the third as "cyan" and any further colours also as "cyan". This corresponds with table 1, column A, lines 1, 2, 3. If, originally, a fourth text-colour is used the relevant part of the text will be given the same colour as the third part of the text. However, if still more colours are used (for example a fifth in addition to the fourth, and possibly a sixth and a seventh), the colours of all these last text-parts will be made equal, for example, to red or magenta. If block 30 is a keyboard, the histogram-former can be inserted at the output of memory 34 and selectively activated, for example by means of manual control. In that case the units 54 and 30 can together be comprised in the same keyboard.

The fact that memory 34 can be accessed for reading as well as writing operations is known per se and will not be discussed any further. The transforming device 38 can be made in a fairly simple manner, for example, by means of a programmable logic array (PLA). In the above case, for example, it can have a six-bit-wide input and a three-bit-wide output. On its input will then appear the original colour code for the relevant pixel (3 bits), and three more bits determining the strategy from unit 32 and/or unit 54. On the output the three bits will appear for controlling the three colour guns of cathode ray tube 40. These three bits can accordingly control a device which forms a multi-coloured hard copy. The number of colours for this device can be selected such that exactly the number of colours is used which can technically be realized. For example in table 1, column A "white" is realized as a black character, "yellow" as a red character, and all others are realized as green characters. It is assumed herewith that the relevant device cannot produce any mixed colours.

Figure 3:
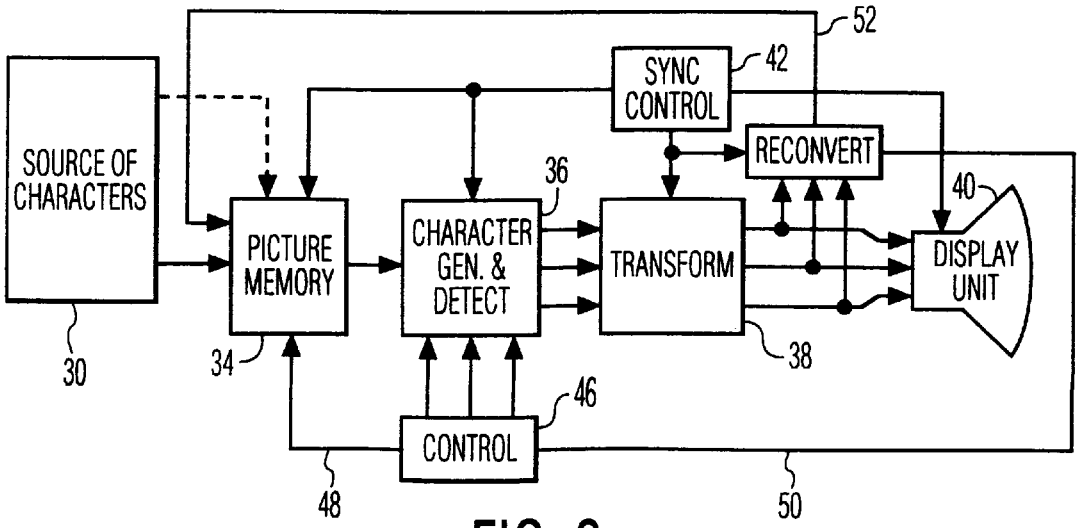
FIG. 3 shows a second embodiment of a multi-coloured display unit in accordance with the invention.

FIG. 3 shows a second embodiment of a multi-coloured display unit in accordance with the invention. Elements in this Figure equal to the elements in FIG. 2 have the same reference numerals. In addition to blocks 34, 36, 38, 40, which produce the actual picture, and control unit 42, there is a second control unit 46. It replaces unit 54 in FIG. 2 and can have corresponding functions. There is further comprised a reconverting block 44. It works in opposite direction to the character generator, as far as the colour is concerned: in this unit the intensity control signals applied to the three guns of the cathode ray tube 40 are reconverted into the relevant colour code. This can be reloaded into memory 34. For that matter a control signal from unit 46 indicates whether the colours in memory 34 can be maintained or if they have to be changed in accordance with the output signals from reconverting device 44. This change only needs to take place once per character. Block 44 is jointly synchronized by control unit 42.

An additional arrangement is formed by a transforming device 38 selectively controlled by control unit 46. A first control mode relates to leaving the colour range unchanged. A second mode relates to forming a uni-coloured output picture. A third mode relates to a two or three or four-coloured output picture as described above for up to seven text colours. The control of a colour range according to table 2 or of a further colour range takes place accordingly.

The above has solely dealt with text. The supporting elements can be similarly subjected to colour transformations. These supporting elements usually consist of pseudo-characters. This means that in a character field of standard dimensions a figure is placed without a direct alphanumerical association. It is likewise possible that so-called "icons" are used. They are pictures which can be displayed to a limited number and have a fixed form and fixed dimensions. They too can be treated as characters although the dimensions are (usually much) larger than those of a single character. Note that the above refers to characters of mutually different sizes, being of the same or not the same importance to the histogram-former 32.

It is likewise possible to use text and graphics, which are "freely formed" pictures. One possibility is having a text memory side by side with a graphics memory, supplying information for mutually excluding parts of the picture field. The above operation, for example, will then only take place with respect to the text memory. Another possibility is that also the pixels stored in the graphics memory are subjected to a colour transformation.

What is claimed is:

1. A method for improving the legibility of text characters to be displayed in color on the screen of a display unit, comprising the steps of:

a. receiving input signals specifying the text characters and respective intended colors thereof selected from a set of possible different colors;

b. in a first state, providing output signals specifying the text characters and intended colors thereof; and c. in a second state:

i. cross-mapping colors, so that at least one of the input signals is changed to specify a new color from the set by the step of assigning colors according to the following table:

| A | B | C | D |
|---|---|---|---|
| 1. white | yellow | cyan | green |
| 2. yellow | cyan | green | white |
| 3. cyan | green | white | yellow |
| 4. green | white | yellow | cyan |
| 5. magenta | magenta | magenta | magenta |
| 6. red | red | red | red |
| 7. blue | blue | blue | blue |
| 8. black | black | black | black |

where the set of possible colors are those in each of the columns of said table and said assigning step includes the following steps:

choosing a column from the table;

identifying a plurality of types of characters within the text to be displayed; and transforming the colors of the characters according to the frequency of the respective types to which the characters belong, so that rows of the chosen column correspond to respective types of characters in decreasing order of frequency, and ii. providing output signals specifying the text characters and respective colors thereof such that the characters are displayed in colors which include at least two different colors from the set whereby the content of the characters is unchanged but their legibility is improved.

* * * * *